US006842120B2

(12) United States Patent
Colberg et al.

(10) Patent No.: US 6,842,120 B2
(45) Date of Patent: Jan. 11, 2005

(54) LUMINOUS ALERTING DEVICE FOR INDICATING AND EMERGENCY EXIT

(75) Inventors: Joachim Colberg, Lasserre (FR); Anja Niemeyer, Neu Wulmstorf (DE); Peter Friedrich, Hamburg (DE); Carsten Kohlmeier-Beckmann, Buxtehude (DE)

(73) Assignees: Airbus, Blagnac (FR); Airbus Deutschland GmbH, Hamburg (DE)

( * ) Notice: Subject to any disclaimer, the term of this patent is extended or adjusted under 35 U.S.C. 154(b) by 40 days.

(21) Appl. No.: 10/434,211

(22) Filed: May 9, 2003

(65) Prior Publication Data

US 2003/0218545 A1 Nov. 27, 2003

(30) Foreign Application Priority Data

May 23, 2002 (FR) ..... 02 06271

(51) Int. Cl.[7] ..... G08B 3/00

(52) U.S. Cl. ..... 340/691.1; 340/815.4; 340/331; 340/332

(58) Field of Search ..... 340/691.1, 815.4, 340/331, 332, 691.3, 691.4, 691.8, 691.5, 286.05; 362/100, 146

(56) References Cited

U.S. PATENT DOCUMENTS 5,297,011 A 3/1994 Triunfol
5,581,230 A * 12/1996 Barrett ..... 340/332
5,594,410 A * 1/1997 Lucas et al. ..... 340/332
5,612,665 A 3/1997 Gerhardsen
6,201,470 B1 3/2001 Withington
6,646,545 B2 * 11/2003 Bligh ..... 340/286.05

FOREIGN PATENT DOCUMENTS

| | | |
|---|---|---|
| FR | 2686177 | 7/1993 |
| GB | 22215105 | 9/1989 |
| GB | 2220288 | 1/1990 |

OTHER PUBLICATIONS

Search Report dated Feb. 10, 2003.

* cited by examiner

*Primary Examiner*—Anh V. La
(74) *Attorney, Agent, or Firm*—Stevens, Davis, Miller & Mosher, LLP

(57) ABSTRACT

A device comprises a luminous indicator intended to indicate an emergency exit and capable of being placed in at least one of three different states, a standby state, in which it emits a first luminous radiation which is continuous and which exhibits a first intensity, an alert state, in which it emits a second luminous radiation which is discontinuous and which exhibits a second intensity greater than the first intensity, and a third state, and an operating unit for operating the luminous indicator in such a way as to place it in the standby state, in a normal situation, in the alert state, during an emergency evacuation via the emergency exit, which is passable, and in the third state, during an emergency evacuation when the emergency exit is impassable.

12 Claims, 3 Drawing Sheets

LUMINOUS ALERTING DEVICE FOR INDICATING AND EMERGENCY EXIT

FIELD OF THE INVENTION

The invention relates to a luminous alerting device for indicating at least one emergency exit which is situated in an enclosed environment.

Within the framework of the present invention, the enclosed environment may in particular be a building (cinema, residential building, school, etc.), a room (conference hall, etc.) of a building, a ship, an aircraft, etc.

PRIOR ART

To allow in a situation of danger (fire, risk of collapse, release of gas, etc.) the emergency evacuation of an enclosed environment such as this, the latter is generally provided with emergency exits, with which emergency devices are usually associated.

Audible or visual means are generally provided as emergency devices in order to alert the persons located in the enclosed environment of the situation of danger and of the need to evacuate said enclosed environment and/or in order to indicate to these persons the direction which they should follow in response to the situation encountered. For example, in the presence of a fire, it may be necessary, firstly to alert the persons of the potential danger then, secondly, to guide them toward a safe environment.

Thus, the emergency devices can be divided into two categories:

- alerting devices; and
- devices indicating the emergency exits to the persons located in the enclosed environment and enabling them to be guided.

It is therefore generally necessary to provide two different types of devices for each emergency exit, this being expensive and cumbersome.

Said alerting devices are aimed solely at attracting the attention of persons to the existence of a potential danger. These devices may, for example, be a siren which is triggered when the scheduled triggering conditions arise (fire for example).

The devices indicating the emergency exits may be luminous indicators emitting luminous signals, in particular luminous panels which are generally used in public premises, such as cinemas for example.

However, such luminous indicators exhibit a twofold drawback:

- firstly, in case of release of smoke (fire or release of chemical product for example), the luminous signals emitted by these luminous indicators are generally hardly visible on account of the screening effect generated by the smoke. Consequently, these luminous signals which are masked from the eyes of persons seeking to evacuate the enclosed environment in which they are located, are no longer of any usefulness. These luminous indicators are therefore ineffective in such a case;
- secondly, the emergency exits pinpointed by the luminous signals may be impassable. They may in particular be blocked, for example by deformation of the frame of the door or by obstruction by an outside element such as a tree or by an inside element such as a collapsed part of the ceiling for example. In such a situation, the luminous indicator continues to indicate an emergency exit which cannot be used for evacuation. In this case, the luminous indicators mislead the persons who wish to leave the enclosed environment.

Moreover, U.S. Pat. No. 6,201,470 discloses an audible device for guiding persons toward an emergency exit when the situation so demands. To do this, this audible device emits, simultaneously and/or successively, sounds comprising a majority of the frequencies among those audible to the human ear. These sound emissions are used simultaneously as alert signal and as orientation signal by virtue of the various frequencies used. They allow the persons to pinpoint the emergency exits and to be guided toward them.

However, in a situation of danger requiring evacuation, the sound level is generally very high [shouting of people, noise generated by the events (fire, etc.) from which the situation of danger stems, etc.] making it difficult, for the human ear, to select between the useful sound emissions and the nuisance background noise or even quite simply to hear the useful sound emissions. This audible device may therefore, in certain situations, not achieve its objectives.

The object of the present invention is to remedy these drawbacks. It relates to a luminous device which is very effective for, at one and the same time:

- alerting the persons located in an enclosed environment of any situation of danger requiring evacuation; and
- indicating a passable emergency exit so as to be able to guide said persons toward this passable emergency exit during an evacuation.

For this purpose, according to the invention, said device which comprises a luminous indicator intended to indicate said emergency exit and operating means for operating said luminous indicator, is noteworthy in that:

- said luminous indicator is able to be placed in one of three different states:
  - a standby state, in which it emits a first luminous radiation which is continuous and which exhibits a first intensity;
  - an alert state, in which it emits a second luminous radiation which is discontinuous and which exhibits a second intensity which is greater than said first intensity; and
  - a third state; and
- said operating means operate said luminous indicator in such a way as to place it:
  - in said standby state, in a normal situation;
  - in said alert state, during an emergency evacuation of said enclosed environment via said emergency exit, the latter being passable; and
  - in said third state, during an emergency evacuation, when said emergency exit is impassable.

According to the invention, said first luminous radiation is such that it does not visually disturb a person located in said enclosed environment, and said second luminous radiation is such that it visually alerts a person located in said enclosed environment of a danger situation and guides him toward said emergency exit.

Thus, by virtue of the invention, in a normal situation, without danger, the luminous indicator emits a first continuous luminous radiation, of low intensity, which makes it possible simply to signal the emergency exit to the persons located in the enclosed environment (building, ship, aircraft, etc.), but which does not disturb them in their business. For example in a cinema, said first luminous radiation must not reduce the darkness required for the proper projection of a film. Said luminous radiation emitted therefore depends on the enclosed environment, to which it is applied. On the other hand, when a situation of danger requiring an evacuation of the enclosed environment is detected, the luminous indicator is placed in the alert state, in which, through a second luminous radiation, which is disturbing because it is discontinuous and of high intensity, it alerts the persons of the situation and guides them toward an emergency exit (passable) which it helps to locate (either by locating it directly, for example by being arranged above said emergency exit, and by thus signaling its position, or by indicating the direction in which this emergency exit is located, for example with the help of an arrow).

It will be noted that the alerting device for indicating an emergency exit in accordance with the invention is especially effective, since, in the alert state, the second luminous radiation emitted is such that it remains visible to the human eye in all circumstances, even in the presence of smoke.

Furthermore, advantageously, said luminous indicator is capable of being placed in said third state, during an emergency evacuation, when said emergency exit is impassable. Thus, during an emergency evacuation, the device in accordance with the invention warns the persons to be evacuated when an emergency exit is impassable.

In a first variant of the invention, said third state corresponds to said standby state, whereas, in a second variant of the invention, in said third state, said luminous indicator emits a third luminous radiation which is different from said first and second luminous radiations.

In both these cases, the persons are still guided toward the impassable emergency exit, but the location of this exit, and moreover the fact of knowing that it is impassable (since the luminous indicator is in the standby state or is emitting said third particular luminous radiation), allows them to visually and easily locate the closest available emergency exit.

In a third variant of the invention, the luminous indicator is off in said third state. In this case, the persons are no longer guided toward the corresponding emergency exit which is, anyhow, impassable.

Moreover, advantageously, said luminous indicator comprises two luminous indicating elements capable of emitting luminous radiations, which are both in the standby state in a normal situation.

In this case, in a first embodiment, only one of said two luminous indicating elements is operated by said operating means upon a change of situation. On the other hand, in a second embodiment, the two luminous indicating elements are operated by said operating means upon a change of situation.

Moreover, advantageously, said luminous indicator comprises:

- at least one luminous indicating means;
- at least two energy supply sources, capable of supplying said luminous indicating means with different energies so that it can emit different luminous radiations; and
- an operable switch capable of connecting said luminous indicating means to one of said supply sources, for the supplying thereof with energy.

Furthermore, advantageously, said operating means comprise:

- first means for generating, as the case may be, an emergency signal;
- second means for generating, as the case may be, a signal informing of the impassability of said emergency exit; and
- third means for operating said luminous indicator, as a function of the signals generated by said first and second means.

In a first embodiment, said second means comprise a member which can be actuated manually.

In a second embodiment, said second means comprise:

- at least one sensor capable of measuring the value of at least one parameter representative of the impassability of said emergency exit; and
- at least one processing means capable of generating a signal informing of the impassability of said emergency exit, as a function of the value of said parameter, measured by said sensor.

BRIEF DESCRIPTION OF THE DRAWING

The figures of the appended drawing will elucidate the manner in which the invention may be embodied. In these figures, identical references designate similar elements.

DESCRIPTION OF PREFERRED EMBODIMENT (S)

Figure 1:
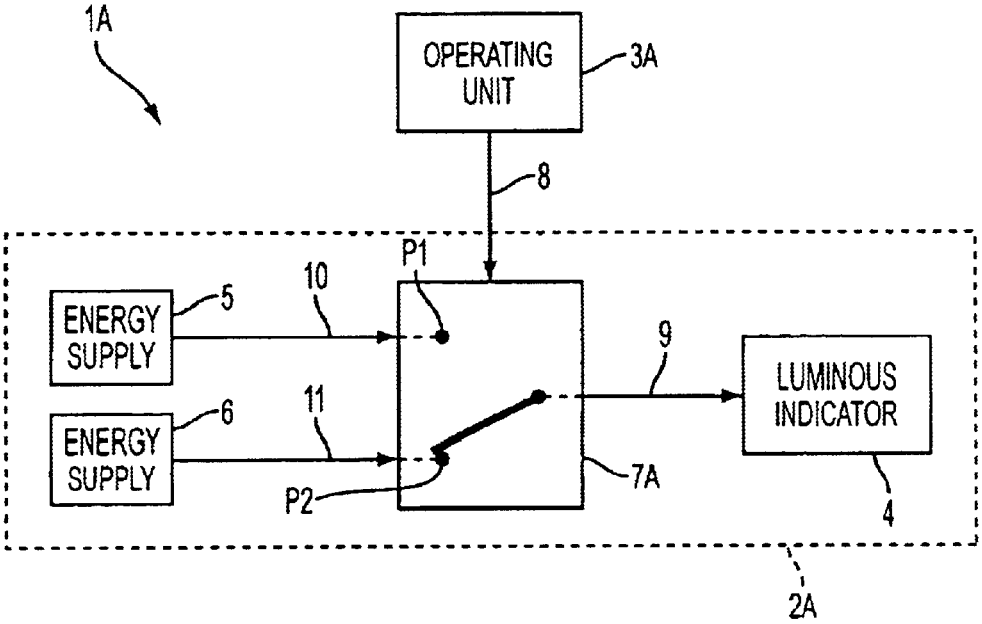
FIGS. 1 and 2 represent the schematic diagrams of two variant embodiments of the device in accordance with the invention.
Figure 2:
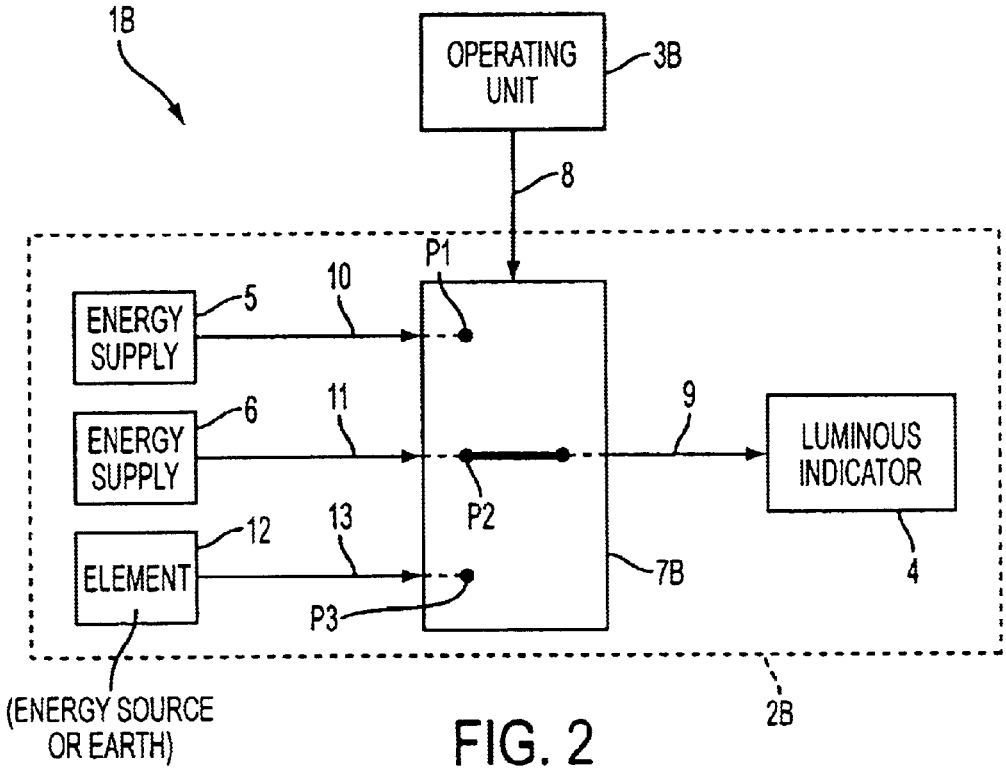

The device in accordance with the invention and represented according to two different embodiments 1A and 1B respectively in FIGS. 1 and 2, is an alerting device for indicating at least one emergency exit (not represented) of an enclosed environment such as a building (cinema, residential building, school, etc.), a room (conference hall, etc.) of a building, a ship, an aircraft, etc.

According to the invention, said device 1A, 1B comprises:

- a luminous indicator 2A, 2B intended to indicate said emergency exit and able to be placed in at least one of two different states:
  - a standby state, in which it emits a first luminous radiation which is continuous and which exhibits a first reduced intensity; and
  - an alert state, in which it emits a second luminous radiation which is discontinuous and which exhibits a second intensity which is greater than said first intensity; and
  - a third state; and
- operating means 3A, 3B to operate said luminous indicator 2A, 2B in such a way as to place it:
  - in said standby state, in a normal situation, that is to say in the absence of danger (therefore no alert or evacuation); and
  - in said alert state, during an emergency evacuation of said enclosed environment in case of danger (fire, etc.) via said emergency exit, the latter being passable.

According to the invention, said first luminous radiation (continuous and of low intensity) is such that it does not visually disturb a person located in said enclosed environment, and said second luminous radiation (discontinuous and of high intensity) is such that it visually alerts any person located in said enclosed environment, of the danger and of the need to evacuate the enclosed environment and guides said person toward at least one emergency exit.

Preferably, said first luminous radiation is a neutral light (white for example) and said second luminous radiation exhibits a green color. Tests have, indeed, shown that the color green which is, in general, associated with a "positive" signal (traffic lights, security entrance to a bank, etc.) and which is therefore recognized by the public, is that which enables persons to be best guided toward an emergency exit.

Figure 5:
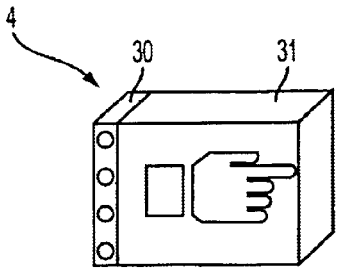
FIGS. 5 and 6 diagrammatically show, in perspective, two different embodiments of a luminous indicating means of a device in accordance with the invention.
Figure 6:
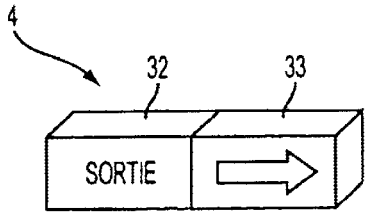

Thus, by virtue of the invention, in a normal situation, without danger, the luminous indicator 2A, 2B emits a (first) continuous luminous radiation of low intensity, which makes it possible simply to signal at least one emergency exit to the persons located in the enclosed environment (building, ship, aircraft, etc.), but which does not disturb them in their business. For example in a cinema, said first luminous radiation must not reduce the darkness required for the proper projection of a film. Said luminous radiation emitted therefore depends on the enclosed environment, to which it is applied. On the other hand, when a situation of danger requiring an evacuation of the enclosed environment is detected, the luminous indicator 2A, 2B is placed in the alert state, in which, through a (second) luminous radiation, which is disturbing because it is discontinuous and of high intensity, it alerts the persons of the situation and guides them toward an emergency exit which it helps to locate [either by locating it directly, for example by being arranged above said emergency exit, and by thus signaling its position, or by indicating the direction in which this emergency exit is located, for example with the help of an arrow (FIG. 6) or a hand (FIG. 5)].

It will be noted that said device 1A, 1B in accordance with the invention therefore serves, when a situation of danger arises, at one and the same time:

to alert the persons of said situation of danger; and to guide said persons toward at least one emergency exit.

Moreover, this alerting device 1A, 1B for indicating an emergency exit is especially effective, since, in the alert state, the (second) luminous radiation emitted is such (discontinuous and of high intensity) that it remains visible to the human eye in all circumstances, even in the presence of smoke, and thus makes it possible to guide the persons toward the emergency exit.

Furthermore, advantageously, said luminous indicator 2A, 2B is able to be placed in a third state, and said operating means 3A, 3B place said luminous indicator 2A, 2B in said third state, during an emergency evacuation, when said emergency exit is impassable.

Thus, during an emergency evacuation, the device 1A, 1B in accordance with the invention warns the persons to be evacuated when an emergency exit has become impassable.

According to the invention, said luminous indicator 2A, 2B comprises, as may be seen in FIGS. 1 and 2:

at least one luminous indicating means 4;

at least two energy supply sources 5 and 6, capable of supplying said luminous indicating means 4 with different energies so that it can emit different luminous radiations; and an operable switch 7A, 7B which is connected by links 8, 9, 10 and 11 respectively to said operating means 3A or 3B, to the luminous indicating means 4, to the supply source 5 and to the supply source 6, and which is capable of connecting said luminous indicating means 4 to one of said supply sources 5 and 6 for the energy supply thereof.

The operating means 3A, 3B are therefore able to operate the switch 7A, 7B so as to place it at least in one of the two positions P1 and P2 such that:

in the position P1, the means 4 is supplied with electrical energy by the source 5; and in the position P2, said means 4 is supplied with electrical energy by the source 6.

Figure 3:
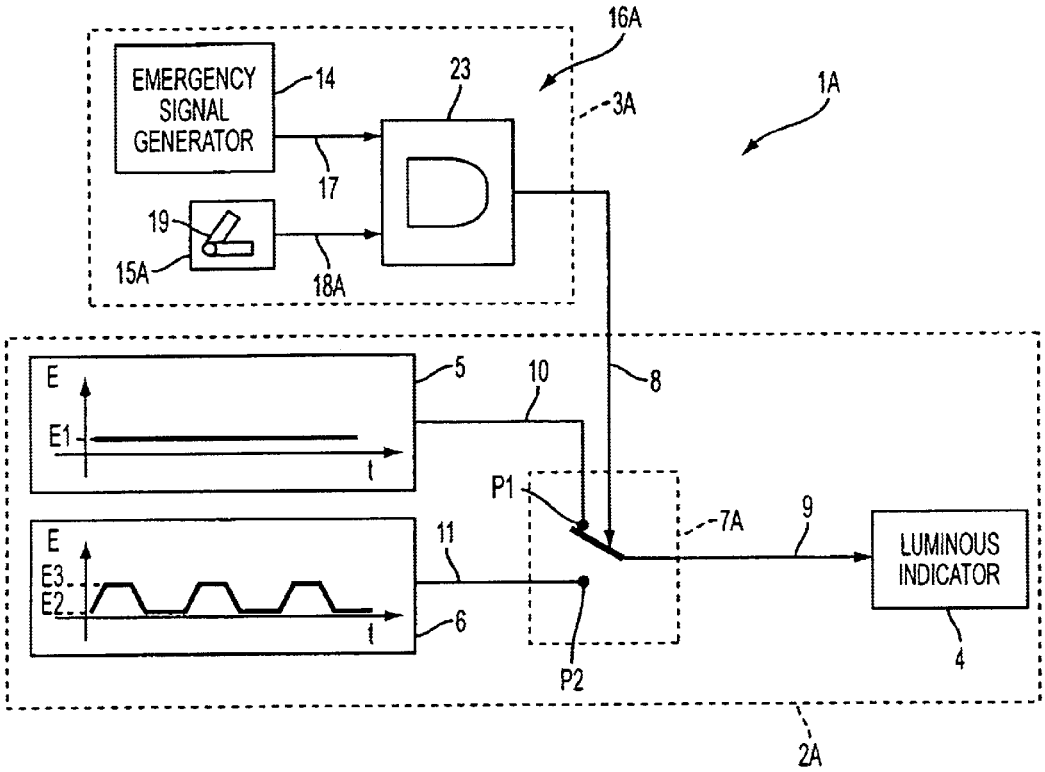
FIG. 3 diagrammatically shows a particular embodiment of the device represented in FIG. 1.
Figure 4:
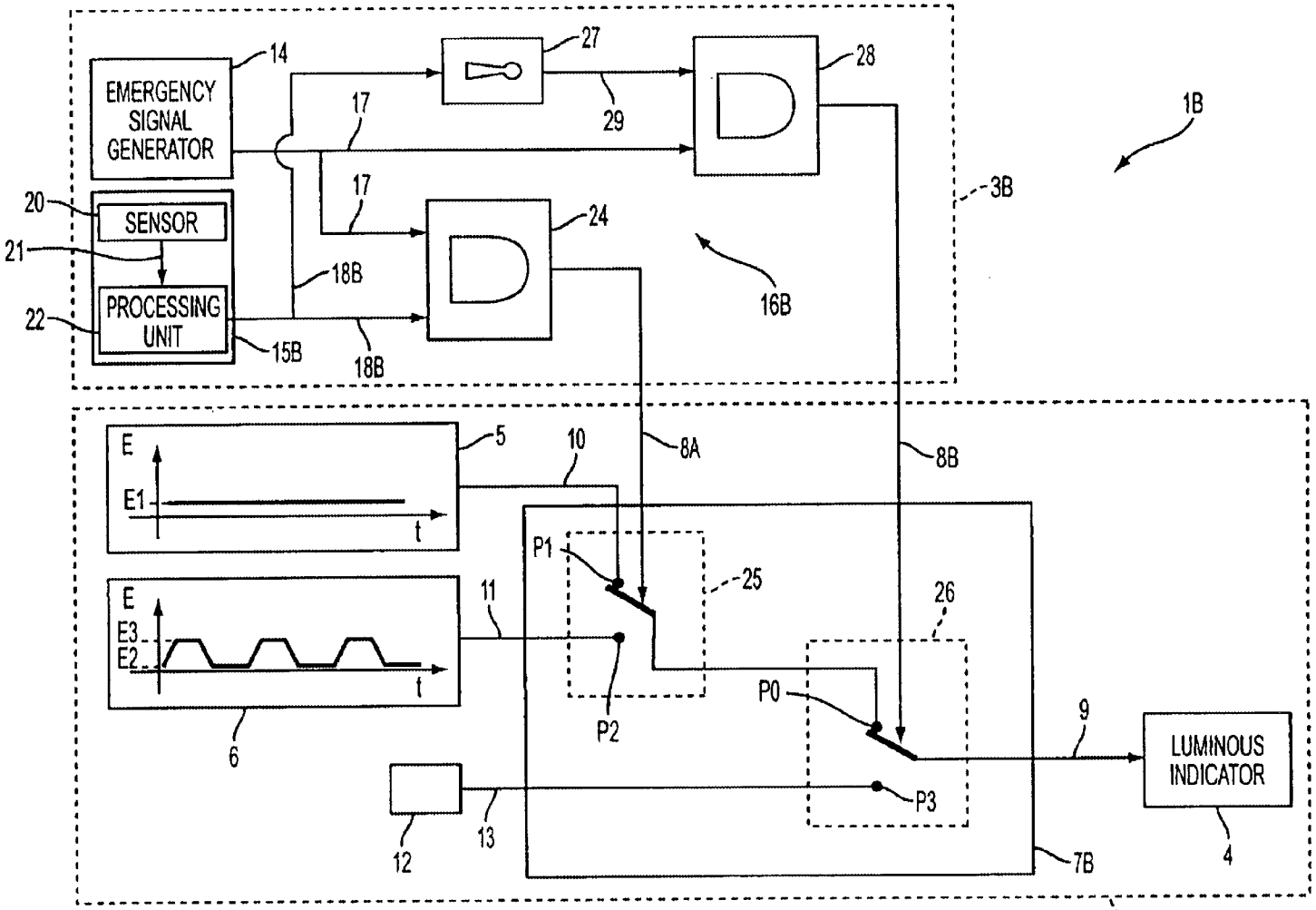
FIG. 4 diagrammatically shows a particular embodiment of the device represented in FIG. 2.

As may be seen in FIGS. 3 and 4:

the supply source 5 provides energy E (as a function of time t) which is continuous and which exhibits a low value E1. Thus, when it is connected to this source 5, the means 4 emits said first luminous radiation (luminous indicator 3A, 3B in the standby state); and the supply source 6 provides energy E which is discontinuous between a minimum value E2 and a maximum value E3, this latter being high. Thus, when it is connected to this source 6, the means 4 emits said second luminous radiation (luminous indicator 3A, 3B in the alert state).

In the first embodiment 1A represented in FIG. 1, the third state in which the means 4 is placed when, during an emergency evacuation, the emergency exit is impassable, is said standby state, that is to say the switch 7A is operated by the operating means 3A so as to revert to said position P1. The means 4 is then connected to the source 5 for supplying continuous and low energy and emits said first luminous radiation.

Furthermore, in the second embodiment 1B represented in FIG. 2, the third state in which the means 4 is placed when, during an emergency evacuation, the emergency exit is impassable, corresponds to a specific state. To do this, the switch 7B is operated by the operating means 3B so as to take a position P3 making it possible to connect the means 4 to an element 12 (link 13).

In a first variant, said element 12 is a third energy supply source, providing an energy which is different than those provided by the sources 5 and 6 so that the means 4 then emits a third particular luminous radiation, which is different than said first and second luminous radiations.

In this case, the persons are still guided toward the impassable emergency exit, but the location of this exit and, moreover, the fact of knowing that it is impassable (emission of said third particular luminous radiation), enables them to easily locate, visually, the closest available emergency exit.

It will be noted that, according to the invention, the various energy supply sources may be joined into a single unit capable of providing the various energies demanded.

In a second variant, said element 12 is the earth so that the means 4 is no longer supplied with energy when it is connected to this element 12 and therefore goes off. In this case, the persons are no longer guided toward the corresponding emergency exit, which is anyhow impassable.

Moreover, according to the invention, as may be seen more precisely in FIGS. 3 and 4, said operating means 3A, 3B comprise:

first means 14 for generating, as the case may be, an emergency signal warning of a danger and of the need to evacuate the enclosed environment;

second means 15A, 15B for generating, as the case may be, a signal informing of the impassability or otherwise of the emergency exit used for evacuation; and third means 16A, 16B (which are connected by a link 17 to the first means 14 and by a link 18A, 18B to the second means 15A, 15B) for operating said luminous indicator 2A, 2B, as a function of the signals generated by said first and second means.

Preferably, said first means 14 are means which can be actuated manually, in particular by somebody in charge of the enclosed environment, for example the captain of an airplane. In a normal situation, said first means 14 are not activated and, when they are activated, they emit said emergency signal (evacuation order).

As far as the second means are concerned, they may comprise:

a manual member 19, preferably of the type with contactor (handle, on/off switch, etc.), as represented in FIG. 3; or an automatic device 15B specified hereinbelow, as represented in FIG. 4; or simultaneously a manual member 19 and an automatic device 15B.

According to the invention, said automatic device 15B comprises:

at least one sensor 20 (position, pressure, etc.) capable of measuring the value of at least one parameter representative of the impassability of the emergency exit;

at least one processing means 22 connected by a link 21 to the sensor 20 and capable of generating a signal informing of the impassability of said emergency exit, as a function of the value of said parameter, measured by said sensor 20.

As may be seen in FIG. 3, the means 16A comprise, for example, an AND logic gate 23. As long as an emergency signal (first means 14) is not emitted, this gate 23 does not deliver any signal so that the switch 7A remains in the initial position P1 (standby state for the indicator 2A). It toggles into the position P2 (alert state for the indicator 2A) when an emergency signal (first means 14) is emitted, as well as a signal informing that the emergency exit is passable (second means 15A). Such a toggling order is however cancelled when said second means 15A emit an impassability signal (return to the position P1).

Moreover, the means 16B represented in FIG. 4 comprise an AND logic gate 24 similar to the gate 23, which is connected (link 8A) to a switching means 25 similar to the switch 7A, so as to operate the switching between the sources 5 and 6. Said means 16B furthermore comprise, in order to operate the switching between a source 5, 6 and the element 12 (third energy supply source or earth) by way of a switching means 26:

a logic gate 27 of "inverter" type, which is connected to the output of the second means 15B capable of emitting a signal informing as to whether the emergency exit is or is not passable. This information is therefore inverted; and an AND logic gate 28 which is connected to the output of the gate 27 by a link 29, as well as to the output of the first means 14 capable of emitting an emergency signal.

This logic gate 28 makes it possible to switch, by virtue of a link 8B, the switching means 26 between a position P0 (allowing the link to the switching means 25) and the position P3.

Moreover, in a particular embodiment said luminous indicating means 4 comprises two luminous indicating elements 30 and 31 (FIG. 5), 32 and 33 (FIG. 6), which are both in the standby state, in a normal situation.

In a first variant, only one of said two luminous indicating elements, namely preferably the element 30 (FIG. 5) or 33 (FIG. 6), is operated by said operating means 3A, 3B upon a change of situation and is placed in said alert state or in said third state, according to the situation. This element 30 or 33 comprises, for example, an array of light-emitting diodes. The other element 31, 32 remains, for its part, always in the standby state.

On the other hand, in a second variant, the two luminous indicating elements 30 and 31, 32 and 33 are operated simultaneously, upon a change of situation.

What is claimed is:

1. A luminous alerting device for indicating at least one emergency exit of an enclosed environment, said device comprising a luminous indicator intended to indicate said emergency exit and operating means for operating said luminous indicator, wherein:

said luminous indicator is able to be placed in one of three different states:

a standby state, in which it emits a first luminous radiation which is continuous and which exhibits a first intensity;

an alert state, in which it emits a second luminous radiation which is discontinuous and which exhibits a second intensity which is greater than said first intensity; and a third state; and said operating means operate said luminous indicator in such a way as to place it:

in said standby state, in a normal situation;

in said alert state, during an emergency evacuation of said enclosed environment via said emergency exit, the latter being passable; and in said third state, during an emergency evacuation, when said emergency exit is impassable.

2. The device as claimed in claim 1, wherein said first luminous radiation is such that it does not visually disturb a person located in said enclosed environment, and wherein said second luminous radiation is such that it visually alerts a person located in said enclosed environment of a danger situation and guides him toward said emergency exit.

3. The device as claimed in claim 1, wherein said third state corresponds to said standby state.

4. The device as claimed in claim 1, wherein, in said third state, said luminous indicator emits a third luminous radiation which is different than said first and second luminous radiations.

5. The device as claimed in claim 1, wherein, in said third state, said luminous indicator is off.

6. The device as claimed in claim 1, wherein said luminous indicator comprises two luminous indicating elements capable of emitting luminous radiations, which are both in the standby state in a normal situation.

7. The device as claimed in claim 6, wherein only one of said two luminous indicating elements is operated by said operating means upon a change of situation.

8. The device as claimed in claim 6, wherein the two luminous indicating elements are operated by said operating means upon a change of situation.

9. The device as claimed in claim 1, wherein said luminous indicator comprises:

at least one luminous indicating means;

at least two energy supply sources, capable of supplying said luminous indicating means with different energies so that it can emit different luminous radiations; and an operable switch capable of connecting said luminous indicating means to one of said supply sources, for the supplying thereof with energy.

10. The device as claimed in claim 1,
wherein said operating means comprise:

first means for generating, as the case may be, an emergency signal;

second means for generating, as the case may be, a signal informing of the impassability of said emergency exit; and third means for operating said luminous indicator, as a function of the signals generated by said first and second means.

11. The device as claimed in claim 10,
wherein said second means comprise a member which can be actuated manually.

12. The device as claimed in claim 10, wherein said second means comprise:

at least one sensor capable of measuring the value of at least one parameter representative of the impassability of said emergency exit; and at least one processing means capable of generating a signal informing of the impassability of said emergency exit, as a function of the value of said parameter, measured by said sensor.

* * * * *